United States Patent [19]

Norwood

[11] Patent Number: 4,945,803

[45] Date of Patent: Aug. 7, 1990

[54] DOUBLE BEAT BASS DRUM PEDAL ASSEMBLY

[76] Inventor: Paul J. Norwood, 1541 Old Rte. 20, West, Norwalk, Ohio 44857

[21] Appl. No.: 408,067

[22] Filed: Sep. 15, 1989

[51] Int. Cl.[5] ..... G10D 13/02

[52] U.S. Cl. ..... 84/422.1

[58] Field of Search ..... 84/422.1, 422.2

[56] References Cited

U.S. PATENT DOCUMENTS 4,782,733 11/1988 Herring ..... 84/422.1

FOREIGN PATENT DOCUMENTS 2820820 11/1979 Fed. Rep. of Germany ..... 84/422.1

3731992 4/1988 Fed. Rep. of Germany ..... 84/422.1

*Primary Examiner*—Lawrence R. Franklin

*Attorney, Agent, or Firm*—Joseph Scafetta, Jr.

[57] ABSTRACT

A double beat bass drum pedal assembly is adaptable for placement adjacent to a head of a bass drum. The pedal assembly includes a base, a first pair of upstanding posts, a second pair of shorter posts, a first shaft, two disks rotatably mounted on the first shaft, a first mallet, a second mallet, a second shaft, a one-piece foot pedal rockably mounted on the second shaft, a first flexible linkage chain, a second flexible linkage chain, a first spring for rotating the first mallet out of contact with the head of the bass drum upon depression of the toe portion of the foot pedal, and a second spring for rotating the second mallet out of contact with the head of the bass drum upon depression of the heel portion of the foot pedal.

9 Claims, 3 Drawing Sheets

NEUTRAL POSITION

INITIAL RIGHT MOVEMENT

LEFT STRIKING POSITION

RIGHT STRIKING POSITION

INITIAL LEFT MOVEMENT

DOUBLE BEAT BASS DRUM PEDAL ASSEMBLY

CROSS-REFERENCE TO RELATED DISCLOSURE

This application is related to Disclosure Document No. 212,694 filed Oct. 21, 1988.

BACKGROUND OF THE INVENTION

1. Field of the Invention

This application relates to musical instruments in general and to bass drums in particular.

2. Description of the Related Art

Drummers today must use two bass drums in order to obtain a so-called "double beat". However, when using two such drums, it is necessary for the drummer to lock down a complementary cymbal, thus losing the so-called "high hat" effect.

Various attempts have been made in the past to obtain a double beat without the use of a second drum and without losing the high hat effect obtained with the cymbal. However, the devices developed by these earlier attempts have operated with undesirable mechanical noises that have rendered the previous inventions somewhat unsatisfactory. Consequently, such prior art devices have met with little, if any, commercial success. Examples of such prior art devices are disclosed in the following: U.S. Pat. No. 2,484,302 issued to Laverents on Oct. 11, 1949; U.S. Pat. No. 3,618,441 issued to Fearns on Nov. 9, 1971; U.S. Pat. No. 3,677,128 issued to Simpson on July 18, 1972; U.S. Pat. No. 3,988,957 issued to Escamilla on Nov. 2, 1976; and U.S. Pat. No. 4,188,853 issued to Bills on Feb. 19, 1980.

Laverents shows a double action bass drum pedal using a rigid foot pedal connected through a linkage to a pair of beaters which use either a linkage arrangement, as shown in FIG. 3, or a gear arrangement, as shown in FIG. 4. One beater is operated to strike the drum by depressing the heel while the other beater is operated to strike the drum when pressing with the toe.

Fearn's development is directed to a double acting drum pedal with a single beater that may be operated by the up and down motion of the pedal.

Simpson's device pertains to a bass drum pedal assembly with a pair of drums being arranged face to face and having a split pedal that allows either a simultaneous or an alternating beat.

Escamilla's invention relates to a drum pedal assembly in which the foot pedal is made up of two halves mounted at a pivot. The front portion is moved by the toe of the operator while the back portion is operated by the drummer's heel.

Most recently, Bills discloses a multiple purpose double acting drum pedal having two beaters with a mechanism to either engage or disengage such beaters.

Despite those different approaches, it remains a problem for drummers to obtain a smooth and noiseless double beat without the use of a second drum and without losing the high hat effect obtained with the attached cymbal.

SUMMARY OF THE INVENTION

The present invention relates to a bass drum pedal assembly that smoothly obtains a double beat without producing extraneous noise, without the use of a second drum, and without losing the high hat effect of a complementary cymbal.

A key advantage of the present invention is that a musical band can save the cost of a second bass drum, thus resulting in less equipment to handle and carry from performance to performance.

Other advantages of the present invention will become readily apparent to those persons skilled in the playing of bass drums from the following brief description of the drawings and from the subsequent detailed description of the preferred embodiment.

DETAILED DESCRIPTION OF THE PREFERRED EMBODIMENT

Figure 1:
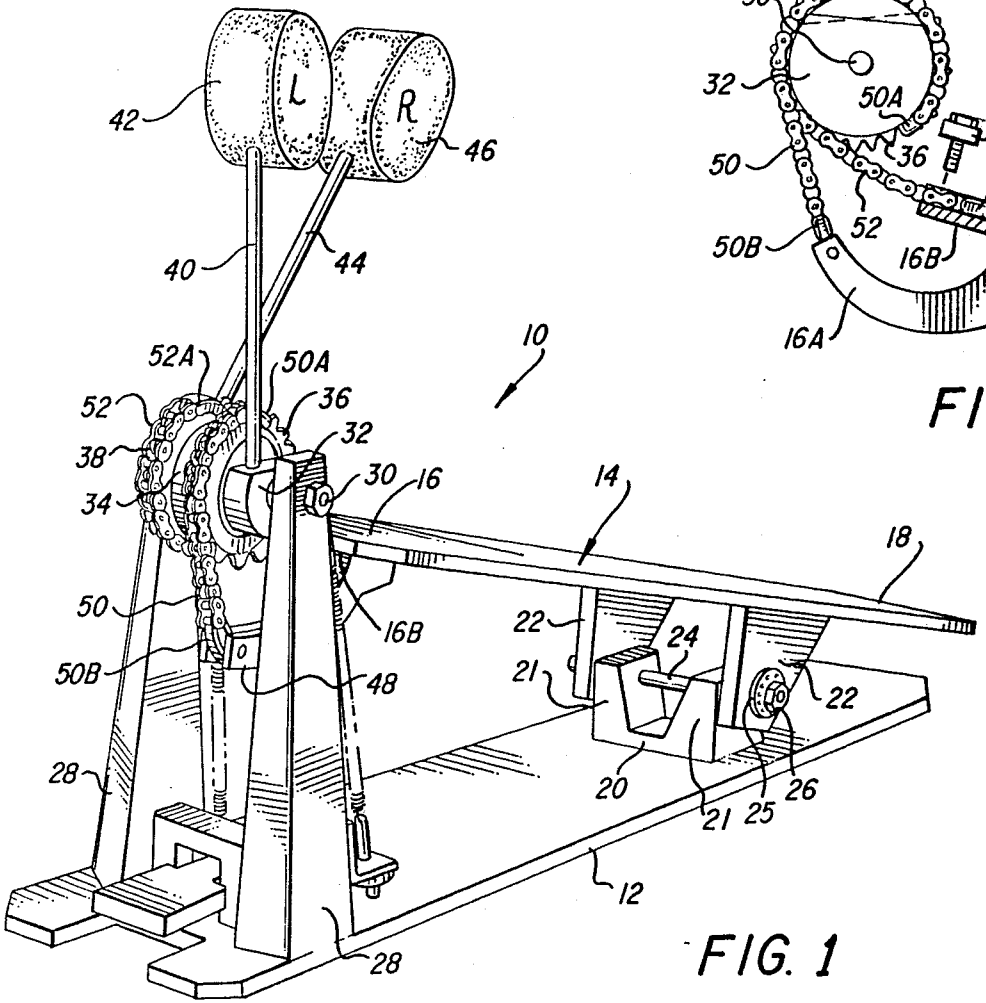
FIG. 1 is a perspective view seen from a left front corner of the present invention.

In FIG. 1, the preferred embodiment of the assembly 10 is shown to include a base 12 to which a foot pedal 14 is pivotably attached. The foot pedal 14 has an upper front toe portion 16 and a lower heel portion 18. The base 12 has a fulcrum 20 on the upper side of its rear portion while the foot pedal 14 has a pair of depending plates 22 on the lower side of its heel portion 18. A pin 24 passes through both the fulcrum 20 and the plates 22. Bearings 25 allow the plates 22 with the pin 24 therethrough to pivot smoothly and silently around the fulcrum 20. The pin 24 is secured at its opposite ends by fasteners 26 which retain the plates 22 and the bearings 25 on opposite sides of the fulcrum 20 so that the plates 22 can rotate around the pin 24, thus pivoting the foot pedal 14 relative to the stationary base 12.

On the upper side of its front portion, the base 12 has two upstanding posts 28. Near the top of each post 28, a pin 30 passes therethrough. This pin 30 also passes through centers of a left rotatable disk 32 and a right rotatable disk 34. Both disks 32 and 34 are secured by the pin 30 between the tops of the posts 28. Sprocket wheels 36 and 38 are fixed to the disks 32 and 34, respectively, so that each sprocket wheel 36 and 38 rotates with its companion disk 32 and 34, respectively. Also, a first stick 40 on which there is mounted a left mallet 42 is fixed to the disk 32 and is rotated therewith. Likewise, a second stick 44 on which there is mounted a right mallet 46 is fixed to the disk 34 and is rotated therewith. A first flexible chain 50 is secured at its one end 50A to the sprocket wheel 36 and is wrapped partially around the outer periphery of the disk 32. This first chain 50 is secured at its opposite end 50B to an arm 48 that depends from the lower side of a front edge 16B of the toe portion 16 of the pedal 14. A second flexible chain 52 is secured at its one end 52A to the sprocket wheel 38 and is wrapped in a similar manner around the outer periphery of the disk 34.

Figure 2:
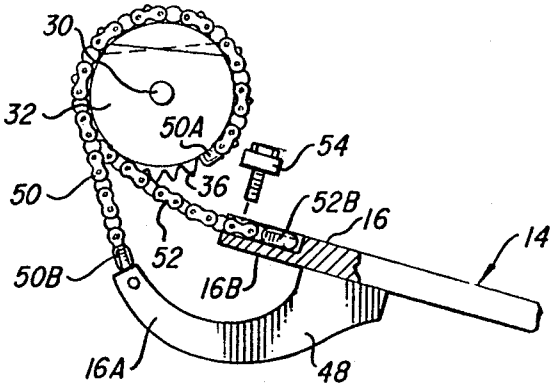
FIG. 2 is a left side elevational view of two rotatably mounted disks and flexible linkage chains wrapped therearound when the invention is in a neutral nonoperating position.

By referring now to FIG. 2 which is a left side elevational view of FIG. 1, the flexible linkage chains 50 and 52 and their connections to the foot pedal 14 may be better understood. Continuing with the description of the flexible linkage chain 52, it may be seen that this second chain 52 is secured at its opposite end 52B by a fastener 54 that is fixed on the upper side of the front edge 16B of the toe portion 16 of the pedal 14.

Returning to the other flexible linkage chain 50 as it is shown in FIG. 2, it may be readily seen that the first chain 50 is secured at its one end 50A to the sprocket wheel 36 and is wrapped partially around the rotatable disk 32 which, in turn, is mounted on the pin 30. The first chain 50 is secured at its opposite end 50B to one end 16A of the arm 48 which depends from the lower side of the front edge 16B of the toe portion 16 of the pedal 14.

Figure 3:
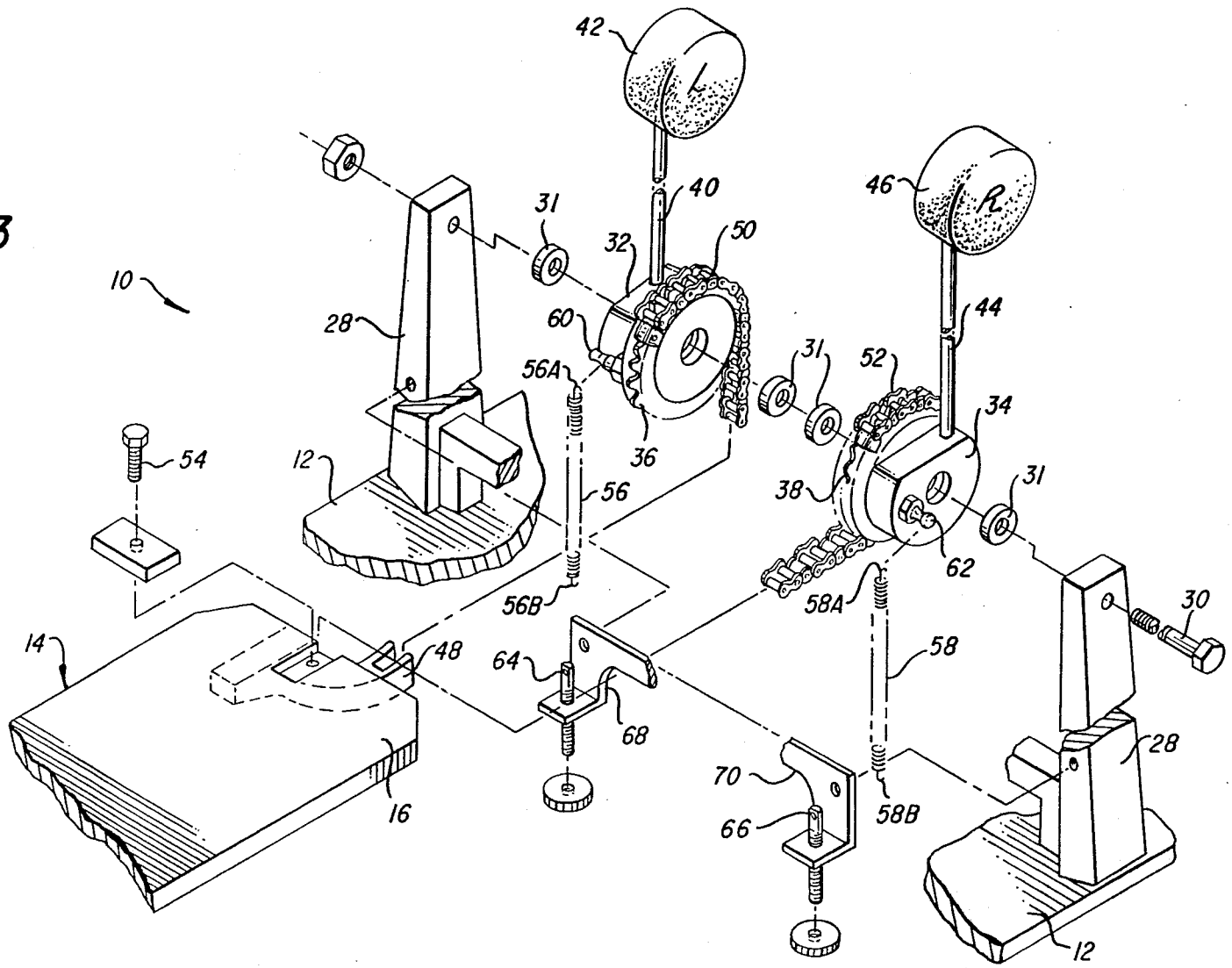
FIG. 3 is an exploded view of the front parts of the present invention.

Turning now to the exploded view of FIG. 3 which shows part of the assembly 10 from the diametrically opposite corner from which the assembly 10 is shown in FIG. 1, one sees the base 12, the foot pedal 14 with its toe portion 16, the posts 28, the pin 30, the left rotatable disk 32, the right rotatable disk 34, the left sprocket wheel 36, the right sprocket wheel 38, the first stick 40, the left mallet 42, the second stick 44, the right mallet 46, the depending arm 48, the first flexible linkage chain 50, the second flexible linkage chain 52, and the fastener 54. All of these elements were discussed previously in regard to FIGS. 1 and 2.

In FIG. 3, a plurality of bearings 31 is shown to be aligned on the pin 30 between each of the posts 28 and between each of the disks 32 and 34, so that the disks 32 and 34 can rotate smoothly and silently around the pin 30.

Still referring to FIG. 3, a first tension spring 56 has a hook 56A at one end and a hook 56B at its opposite end. Likewise, a second tension spring 58 has a hook 58A at its one end and a hook 58B at its opposite end. The hook 56A at the upper end of the spring 56 engages a first nub 60 that is fixed to and rotatable with the first disk 32. Similarly, the hook 58A at the upper end of the spring 58 engages a second nub 62 that is fixed to and rotatable with the second disk 34. The hook 56B at the lower end of the spring 56 engages an eye 64 that is held by an anchor 68 which, in turn, is fastened to the left post 28. In the same manner, the hook 58B at the lower end of the spring 58 engages an eye 66 that is held by anchor 70 which, in turn, is fastened to the right post 28. Because both springs 56 and 58 are under tension, they tend to pull on the nubs 60 and 62, respectively, thus rotating the disks (32, 34) the sprocket wheels (36, 38), the chains (50, 52), and the mallets (42, 46) in a counterclockwise motion, when viewed from the right side of the assembly 10. The tension of the springs 56 and 58 is overcome only by the pressure exerted by the drummer on the foot pedal 14 whenever either the toe portion 16 or the heel portion 18 is depressed.

The operation of the invention will now be described with reference to FIGS. 4A, 4B, 4C, 5A, and 5B.

Figure 4A:
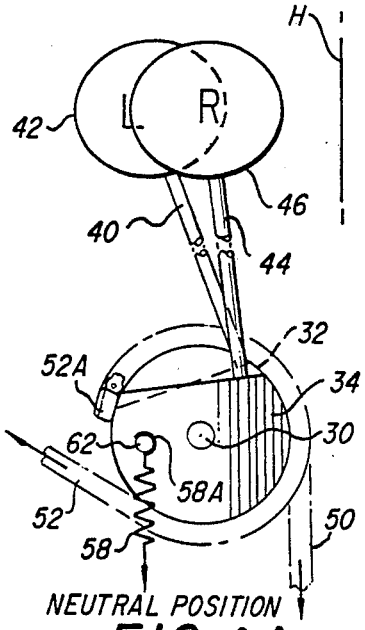
FIG. 4A is a right side elevational schematic view of two mallets mounted on the two rotatable disks and the flexible linkage chain wrapped around the right disk when the invention is in a neutral nonoperating position.

In FIG. 4A, part of the invention is in its neutral position, as seen from the right side of the assembly 10. This view in FIG. 4A shows some of the same structural elements seen in FIG. 2, but from the opposite side. As can be seen in FIG. 4A, the rotatable disk 34 on the shaft 30 is at rest. The spring 58 has its hook 58A engaged around the nub 62 and is in tension so as to counterbalance the pulling force exerted by the chain 52 which is secured at its one end 52A on the periphery of the disk 34. The direction of the tension force exerted by the spring 58, as well as the directions of the pulling forces exerted by the chains 50 and 52, are indicated by unnumbered arrows in FIG. 4A. This counterbalancing of forces allows both the left mallet 42 and the right mallet 46, fixed on the first stick 40 and the second stick 44, respectively, to remain in substantially upright positions on the disks 32 and 34, respectively, so that the mallets 42 and 46 do not inadvertently strike a head H of a drum (not shown).

Figure 4B:
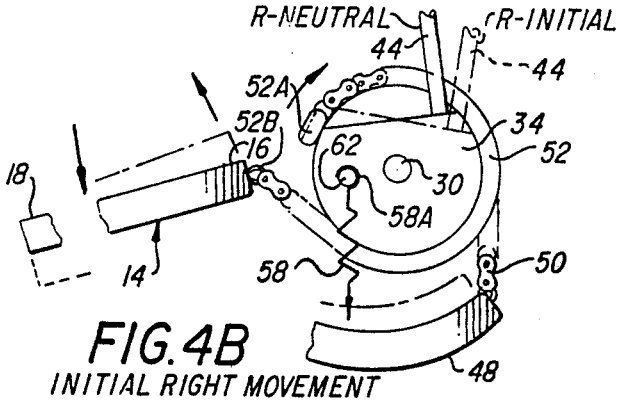
FIG. 4B is a right side elevational schematic view of only the right mallet mounted on its rotatable disk as it moves from the neutral position of FIG. 4A to the striking position of FIG. 4C in response to the drummer's simultaneous depressing of the heel portion and lifting of the toe portion of the pedal.
Figure 5B:
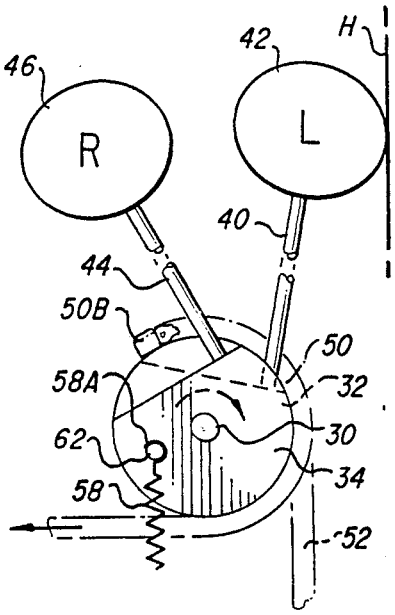
FIG. 5B is a right side elevational schematic view of the two mallets mounted on their respective disks and the flexible linkage chain wrapped around the right disk when the left mallet strikes the head of one bass drum.
Figure 4C:
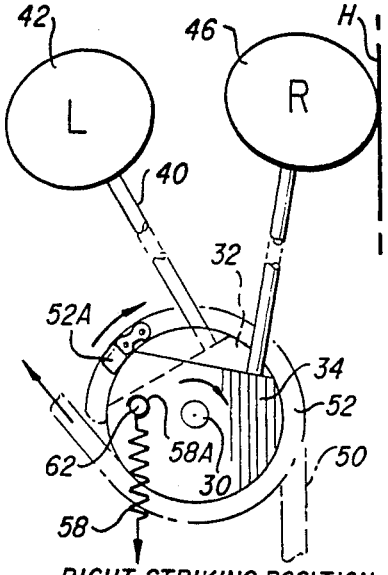
FIG. 4C is a right side elevational schematic view of the two mallets mounted on their respective disks and the flexible linkage chain wrapped around the right disk when the right mallet strikes the head of one bass drum.
Figure 5A:
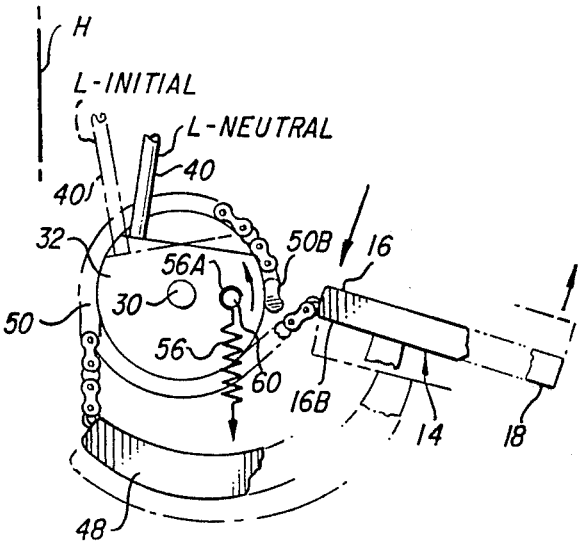
FIG. 5A is a left side elevational schematic view of only the left mallet mounted on its rotatable disk as it moves from the neutral position of FIG. 4A to the striking position of FIG. 5B in response to the drummer's simultaneous depressing of the toe portion and lifting of the heel portion of the pedal.

For the purpose of simplicity, FIGS. 4B and 4C are dedicated to showing the operation of the right side of the invention while FIGS. 5A and 5B are dedicated to showing the operation of the left side of the invention.

As shown in FIG. 4B, when the drummer desires to beat the drum with the right mallet 46 (not shown), he or she lifts the toe portion 16 while simultaneously depressing the heel portion 18 of the foot pedal 14. This foot action by the drummer causes the end 52B of the chain 52 to be pulled upward, thus pulling on the other end 52A of the chain 52 so that the disk 34 with the stick 44 rotates clockwise on the shaft 30 from the solid lined position indicated as "R-Neutral" to the dashed line position indicated at "R-initial". Because the drummer's foot exerts a stronger force in depressing the heel portion 18 and pulling on the chain 52 than the tension force exerted by the spring 58, this tension force is overcome and the nub 62 fixed on the rotating disk 34 stretches the spring 58 by pulling upward on the hook 58A.

From the initial movement shown in FIG. 4B, the right mallet 46 quickly moves to the striking position shown in FIG. 4C wherein the head H of the drum is hit to produce a desired note. This striking of the drum head H by the right mallet 46 is caused when the disk 34 is rotated to a position farther in the clockwise direction on the shaft 30 than the initial position shown in FIG. 4B. At the same time, the one end 52A of the chain 52 continues to move clockwise on the periphery of the rotating disk 34 in response to the pulling of the chain 52 caused by the depression of the beel portion 18 by the drummer's foot (not shown in FIG. 4C). Simultaneously, the nub 62 rotates clockwise with the disk 34, continuing to pull on the spring 58 which has its hook 58A engaged around the nub 62. As may be surmised at this point, when the drummer stops exerting downward pressure on the heel portion 18 of the foot pedal 14 (not shown in FIG. 4C), the tension spring 58 via its hook 58A pulls downwardly on the nub 62, thus causing the disk 34 to rotate counterclockwise on the shaft 30, until the end 52A of the chain 52 returns to its neutral position at which the tension force exerted by the spring 58 is balanced by the pulling force exerted by the chain 52.

For the sake of comparison but not for discussion in regard to FIGS. 4B and 4C, the positions of the chain 50, the depending arm 48, and the left mallet 42 fixed by the stick 40 onto the other rotatable disk 32 are slso shown.

Referring now to FIG. 5A which shows a part of the invention from the left side, one can see the initial movement when the drummer desires to beat the drum with the left mallet (not shown). Initially, the drummer lifts the heel portion 18 of the pedal 14 while simultaneously depressing the toe portion 16. This foot action by the drummer causes the end 50B of the chain 50 to be pulled counterclockwise by the depending arm 48 which is fixed at its end to the underside of the front edge 16B of the toe portion 16 of the pedal 14. Consequently, the disk 32 is rotated counterclockwise around the shaft 30. Because the stick 40 carrying the left mallet 42 (not shown) is fixed to the disk 32, the stick 40 and the left mallet 42 (not shown) rotate in their initial movement in the position indicated in dashed lines by "L-initial" from the position indicated in solid lines by "L-Neutral", shown also in FIG. 4A. The simultaneous depression of the toe portion 16 and the lifting of the heel portion 18 of the foot pedal 14 overcomes the tension force exerted by the spring 56 which is pulled upwardly by its hook 56A that is wrapped around the nub 60 which travels counterclockwise on the disk 32 around the shaft 30.

Shifting now to FIG. 5B which shows the left mallet 42 striking the drum head H, it is important to note that this view is taken from the right side and not the left side so that the feeder can compare the striking position of the left mallet 42 in FIG. 5B with the striking position of the right mallet in FIG. 4C.

From the initial movement shown from the left side in FIG. 5A, the left mallet 42 quickly moves to the striking position shown from the right side in FIG. 5B wherein the head H of the drum is hit to produce a desired note. This striking of the drum head H by the left mallet 42 is caused when the disk 32 is rotated farther in the direction indicated by the dashed arrow around the shaft 30. At the same time, the end 50B of the chain 50 continues to move on the periphery of the rotating disk 32 in response to the pulling of the chain 50 caused by the depression of the heel portion 18 of the drummer's foot (not shown). Simultaneously, the nub 62 on the disk 34 holding the right mallet 46 fixed on the stick 44 is retained in a stationary position by the hook 58A of the spring 58.

To summarize both the description and the operation of the preferred embodiment, FIGS. 1 and 3 will be reviewed again. The double beat bass drum pedal assembly 10 is adaptable for placement adjacent to the head H (FIGS. 4A, 4C, 5A, and 5B) of the bass drum (not shown). The base 12 has a front portion and a rear portion. The first pair of upstanding posts 28 is mounted on the front portion of the base 12. The second pair of shorter posts 21 is mounted on the rear portion of the base 12. The first shaft 30 is fixed between the first pair of upstanding posts 28. Two disks 32 and 34 each have a periphery and each is pivotably mounted on the first shaft 30. The first left mallet 42 is carried by the rotatably mounted disk 32 so as to strike the head H of the bass drum. The second right mallet 46 is carried by the other rotatably mounted disk 34 so as to strike alternately the head H of the bass drum. The second shaft 24 is fixed between the second pair of shorter posts 21. The one-piece foot pedal 14 has an upper toe portion 16 and a lower heel portion 18 and is rockably mounted on the second shaft 24. The first flexible linkage chain 50 is connected between the toe portion 16 of the foot pedal 12 and the periphery of the rotatably mounted disk 32. The first flexible linkage chain 50 rotates the first left mallet 42 into contact with the head H of the bass drum upon depression of the toe portion 16 of the foot pedal 14 counterclockwise around the second shaft 24, as viewed from the left side of FIG. 1. The second flexible linkage chain 52 is connected between the toe portion 16 of the foot pedal 14 and the periphery of the other rotatably mounted disk 34. The second flexible linkage chain 52 rotates the second right mallet 46 into contact with the head H of the bass drum upon depression of the heel portion 18 of the foot pedal 14 clockwise around the second shaft 24, as also viewed from the left side of FIG. 1. The first spring 56, best seen in FIG. 3, is extended between the base 12 and the one rotatably mounted disk 32. The first spring 56 rotates the first left mallet 42 out of contact with the head H of the bass drum upon lifting of the toe portion 16 of the foot pedal 14 counterclockwise around the second shaft 24, as viewed from the left side of FIG. 1. The second spring 58 is extended between the base 12 and the other rotatably mounted disk 34. The second spring 58 rotates the second right mallet 46 out of contact with the head H of the bass drum upon depression of the heel portion 18 of the foot pedal 14 clockwise around the second shaft 24, as viewed from the left side of FIG. 1. The first and second flexible linkage chains 50 and 52 are wrapped partially around the two rotatably mounted disks 32 and 34, respectively. A third post or the arm 48 of arcuate length is mounted on the toe portion 16 of the foot pedal 14 and is connected to the first flexible linkage chain 50. The second flexible linkage chain 52 is connected directly to the toe portion 16 of the foot pedal 14.

Changes in shape, size, and arrangement of the various parts come within the purview of the invention and are to be considered covered by the scope of the appended claims which define the patent protection afforded to the invention.

What I claim as my invention is:

1. A double beat bass drum pedal assembly adaptable for placement adjacent to a head of a bass drum, comprising:

a. a base having a front portion and a rear portion;
b. a first pair of upstanding posts mounted on the front portion of the base;
c. a second pair of shorter posts mounted on the rear portion of the base;
d. a first shaft fixed between the first pair of upstanding posts;
e. two disks, each having a periphery and each being rotatably mounted on the first shaft;
f. a first mallet, carried by one of the two rotatably mounted disks so as to strike the head of the bass drum;
g. a second mallet, carried by the other of the two rotatably mounted disks so as to strike alternately the head of the bass drum;
h. a second shaft fixed between the second pair of shorter posts;
i. a one-piece foot pedal having a toe portion and a heel portion and being pivotably mounted on the second shaft;

j. a first flexible linkage means, connected between the toe portion of the foot pedal and the periphery of one of the two rotatably mounted disks, for rotating the first mallet into contact with the head of the bass drum upon depression of the toe portion of the foot pedal clockwise around the second shaft;

k. a second flexible linkage means, connected between the toe portion of the foot pedal and the periphery of the other of the two rotatably mounted disks, for rotating the second mallet into contact with the head of the bass drum upon depression of the heel portion of the foot pedal counterclockwise around the second shaft;

l. a first spring means, extended between the base and one of the two rotatably mounted disks, for rotating the first mallet out of contact with the head of the bass drum upon pivoting of the toe portion of the foot pedal counterclockwise around the second shaft; and m. a second spring means, extended between the base and the other of the two rotatably mounted disks, for rotating the second mallet out of contact with the head of the bass drum upon pivoting of the heel portion of the foot pedal clockwise around the second shaft.

2. The double beat bass drum pedal assembly according to claim 1, wherein:

said first and second flexible linkage means are wrapped partially around the one and the other of the two rotatably mounted disks, respectively.

3. The double beat bass drum pedal assembly according to claim 2, further comprising:

n. a third post of arcuate length being mounted on the toe portion of the foot pedal and being connected to the first flexible linkage means.

4. The double beat bass drum pedal assembly according to claim 3, wherein:

said second flexible linkage means is connected to the toe portion of the foot pedal.

5. The double beat bass drum pedal assembly according to claim 4, further comprising:

o. a first plurality of bearing means, mounted on the first shaft, for allowing the two disks to rotate smoothly and silently around the first shaft; and p. a second plurality of bearing means, mounted on the second shaft, for allowing the one-piece foot pedal to pivot smoothly and silently around the second shaft.

6. A double beat bass drum pedal assembly adaptable for placement adjacent to a head of a bass drum, comprising:

a. a base;

b. two disks, each having a periphery and each being rotatably mounted on the base;

c. a first mallet, carried by one of the two rotatably mounted disks so as to strike the head of the bass drum;

d. a second mallet, carried by the other of the two rotatably mounted disks so as to strike alternately the head of the bass drum;

e. a first pedal having a toe portion and a heel portion and being pivotably mounted on the base;

f. a first flexible linkage means, connected at one end to the toe portion of the foot pedal and wrapped at an opposite end partially around the periphery of one of the two rotatably mounted disks, for rotating the first mallet into contact with the head of the bass drum upon depression of the toe portion of the foot pedal and also upon partial unwrapping of the first flexible linkage means from around the one of the two rotatably mounted disks; and g. a second flexible linkage means, connected at one end to the toe portion of the foot pedal and wrapped at an opposite end partially around the periphery of the other of the two rotatably mounted disks, for rotating the second mallet into contact with the head of the bass drum upon depression of the heel portion and also upon partial unwrapping of the second flexible linkage means from around the other of the two rotatably mounted disks.

7. The double beat bass drum pedal assembly according to claim 6, further comprising:

h. a first connector extending a predetermined length from the toe portion of the foot pedal and also being connected to the one end of the first flexible linkage means so that the first mallet strikes the head of the bass drum upon depression of the toe portion of the foot pedal and also upon partial unwrapping of the first flexible linkage means from around the one of the two rotatably mounted disks.

8. The double beat bass drum pedal assembly according to claim 7, further comprising:

i. a second connector being mounted on the toe portion of the foot pedal and also being connected to the one end of the second flexible linkage means so that the second mallet strikes the head of the bass drum upon depression of the heel portion of the foot pedal and also upon partial unwrapping of the second flexible linkage means from around the other of the two rotatably mounted disks.

9. The double beat bass drum pedal assembly according to claim 8, further comprising:

j. a first plurality of bearing means, mounted adjacent to the first and second flexible linkage means, for allowing the two disks to rotate smoothly and silently; and k. a second plurality of bearing means, mounted on the base, for allowing the foot pedal to pivot smoothly and silently.

* * * * *